US006048679A

United States Patent [19]

Wang et al.

[11] Patent Number: 6,048,679

[45] Date of Patent: Apr. 11, 2000

[54] ANTISTATIC LAYER COATING COMPOSITIONS

[75] Inventors: Yongcai Wang, Penfield; Dwight W. Schwark, Rochester; Robert J. Kress, Rochester; Alfred B. Fant, Rochester, all of N.Y.

[73] Assignee: Eastman Kodak Company, Rochester, N.Y.

[21] Appl. No.: 09/221,639

[22] Filed: Dec. 28, 1998

[51] Int. Cl.[7] ..... G03C 1/89

[52] U.S. Cl. ..... 430/528; 430/527; 430/529; 430/530

[58] Field of Search ..... 430/523, 527–531, 430/533, 536, 950, 961

[56] References Cited

U.S. PATENT DOCUMENTS

| | | | |
|---|---|---|---|
| 3,033,679 | 5/1962 | Laakso et al. . | |
| 3,437,484 | 4/1969 | Nadeau . | |
| 3,525,621 | 8/1970 | Miller . | |
| 3,630,740 | 12/1971 | Joseph et al. . | |
| 3,681,070 | 8/1972 | Timmerman et al. . | |
| 4,070,189 | 1/1978 | Kelley et al. . | |
| 4,203,769 | 5/1980 | Guestaux | 430/631 |
| 4,237,194 | 12/1980 | Upson et al. | 428/424.2 |
| 4,308,332 | 12/1981 | Upson et al. | 430/62 |
| 4,526,706 | 7/1985 | Upson et al. | 252/500 |
| 4,542,095 | 9/1985 | Steklenski et al. | 430/527 |
| 4,916,011 | 4/1990 | Miller | 430/527 |
| 5,695,919 | 12/1997 | Wang et al. | 430/527 |

*Primary Examiner*—Richard L. Schilling
*Attorney, Agent, or Firm*—Doreen M. Wells

[57] ABSTRACT

The present invention is an imaging element which includes a support, at least one imaging layer superposed on the support and an antistatic layer superposed on the support. The antistatic layer is composed of a wax particle having a wax phase and a polymer phase, the polymer phase formed from an ethylenically unsaturated monomer free of ionic charge groups capable of forming a water soluble homopolymer and a second ethylenically unsaturated monomer capable of forming a water insoluble homopolymer, and an antistatic agent having an ionic group.

10 Claims, No Drawings

ANTISTATIC LAYER COATING COMPOSITIONS

CROSS REFERENCE TO RELATED APPLICATIONS

This application relates to commonly assigned copending application Ser. No. 09/221,469, filed simultaneously herewith. This application relates to commonly assigned copending application Ser. No. 09/221,083, filed simultaneously herewith. This application relates to commonly assigned copending application Ser. No. 09/221,470, filed simultaneously herewith. This application relates to commonly assigned copending application Ser. No. 09/221,465, filed simultaneously herewith. This application relates to commonly assigned copending application Ser. No. 09/221,776, filed simultaneously herewith. This application relates to commonly assigned copending application Ser. No. 09/221,883, filed simultaneously herewith. This application relates to commonly assigned copending application Ser. No. 09/221,516, filed simultaneously herewith. These copending applications are incorporated by reference herein.

FIELD OF THE INVENTION

This invention relates to imaging elements, and in particular to photographic elements composed of an antistatic layer comprising an ionic conductive polymer having improved surface characteristics and manufacturability.

BACKGROUND OF THE INVENTION

Photographic light-sensitive materials are generally composed of light-sensitive photographic emulsion layers and light insensitive layers such as an interlayer, an emulsion protective layer, a filter layer, or an antihalation layer applied, directly or indirectly through a subbing layer, to one side or both sides of the support consisting of, for example, an α-olefin such as polystyrene or polyethylene, a cellulose ester such as cellulose acetate or nitrocellulose, a polyester such as polyethylene terephthalate or polyethylene napththalate, paper, or a synthetic paper. In light-sensitive materials such as color photographic elements, auxiliary layers such as an antistatic layer, a curl preventing layer, a magnetic recording layer, a barrier layer, a scratch resistant overcoat layer, or a surface lubricant layer, are provided on the back side of the support in order to enhance the photographic or physical quality of the photographic light-sensitive materials.

The need to provide photographic film and paper with antistatic protection has long been recognized. Such protection is important since the accumulation of static charges as a result of various factors in the manufacture, finishing, and use of photographic elements is a serious problem in the photographic art. Accumulation of static charges can result in fog patterns in photographic emulsions, various coating imperfections such as mottle patterns and repellency spots, dirt and dust attraction which may result in the formation of "pinholes" in processed films, and a variety of handling and conveyance problems.

To overcome the problem of accumulation of static charges it is conventional practice to provide an antistatic layer (i.e., an electrically conductive layer) in photographic elements. A very wide variety of antistatic layers are known for use in photographic elements. For example, an antistatic layer comprising an alkali metal salt of a copolymer of styrene and styrylundecanoic acid is disclosed in U.S. Pat. No. 3,033,679. Photographic films having a metal halide, such as sodium chloride or potassium chloride, as the conducting material, in a hardened polyvinyl alcohol binder are described in U.S. Pat. No. 3,437,484. In U.S. Pat. No. 3,525,621, the antistatic layer is comprised of colloidal silica and an organic antistatic agent, such as an alkali metal salt of an alkylaryl polyether sulfonate, an alkali metal salt of an arylsulfonic acid, or an alkali metal salt of a polymeric carboxylic acid. An antistatic layer comprised of an anionic film forming polyelectrolyte, colloidal silica and a polyalkylene oxide is disclosed in U.S. Pat. No. 3,630,740. In U.S. Pat. No. 3,681,070, an antistatic layer is described in which the antistatic agent is a copolymer of styrene and styrene sulfonic acid. U.S. Pat. No. 4,542,095 describes antistatic compositions comprising a binder, a nonionic surface-active polymer having polymerized alkylene oxide monomers and an alkali metal salt. In U.S. Pat. No. 4,916,011, an antistatic layer comprising a styrene sulfonate-maleic acid copolymer, a latex binder, and an alkyl-substituted trifunctional aziridine crosslinking agent is disclosed. An antistatic layer comprising a vanadium pentoxide colloidal gel is described in U.S. Pat. No. 4,203,769. U.S. Pat. Nos. 4,237,194, 4,308,332, and 4,526,706 describe antistats based on polyaniline salt-containing layers. Crosslinked vinylbenzyl quaternary ammonium polymer antistatic layers are described in U.S. Pat. No. 4,070,189.

The surface lubricant layer is normally applied as the outermost layer, as is the case for a backing layer. It is desirable for this layer to have a low coefficient of friction (COF) to provide proper conveyance properties and to protect the imaging elements from mechanical damage during the manufacturing process or customer use. It is known to protect imaging elements against mechanical damage by coating them with a layer comprising a lubricant such as a wax. However, it has proven difficult to provide a single layer applied from organic medium that comprises both an antistatic agent and a lubricant since it is difficult to find a coating medium that dissolves both the antistat and the lubricant and is at the same time attractive from an environmental and health standpoint. In addition, it is difficult to form a stable dispersion of a lubricant such as a wax in an organic medium that may be added to a coating composition containing an antistatic agent. Therefore, in order to form a backing layer which can be applied from liquid organic medium that is both conductive and has a low coefficient of friction one often applies two separate layers; a first layer which is comprised of an antistatic agent and then a second layer which is comprised of a lubricant such as a wax.

It is always desirable to have a backside protective overcoat that serves as many functions as possible in order to reduce manufacturing complexity and cost. It is also desirable to have such a layer formed by coating and drying from coating compositions based on solvents that are less hazardous to the environment.

An objective of the invention is to provide image elements with an antistatic layer comprising an ionic conductive polymer having improved manufacturability and surface characteristics.

SUMMARY OF THE INVENTION

The present invention is an imaging element which includes a support, at least one imaging layer superposed on the support and an antistatic layer superposed on the support. The antistatic layer is composed of a wax particle having a wax phase and a polymer phase, the polymer phase formed from an ethylenically unsaturated monomer free of ionic charge groups capable of forming a water soluble homopolymer and a second ethylenically unsaturated monomer capable of forming a water insoluble homopolymer, and an antistatic agent having an ionic group.

DETAILED DESCRIPTION OF THE INVENTION

The present invention provides an imaging element with an antistatic layer containing materials which exhibit ionic conductivity, i.e. having an ionic group, and a composite wax particle having a wax phase and a polymer phase wherein said polymer phase includes a monomer free of ionic charge group and capable of addition polymerization to form a water soluble homopolymer. Antistatic layers having ionic groups include, inorganic salts, ionic conductive polymers, and colloidal metal oxide sols stabilized by salts. U.S. Pat. No. 4,542,095 discloses antistatic compositions for use in photographic elements wherein aqueous latex compositions are used as binder materials in conjunction with polymerized alkylene oxide monomers and alkali metal salts as the antistatic agents. U.S. Pat. No. 4,916,011 describes antistatic layers comprising ionically conductive styrene sulfonate interpolymers, a latex binder, and a crosslinking agent. U.S. Pat. No. 5,045,394 describes antistatic backing layers containing Al-modified colloidal silica, latex binder polymer, and organic or inorganic salts that provide good writing or printing surfaces.

The preferred antistatic agents for the practice of the invention are conductive ionene polymers or copolymers. The ionene groups can be contained in the polymer chain backbone or in the side chain. The ionene groups are either quaternary ammonium salt group or phosphonium salt group. Polymers having ionene groups in the side chain are represented by the Formula (I):

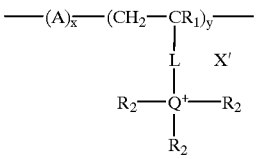

(I)

wherein A represents an ethylenically unsaturated monomer unit, $R_1$ represents a hydrogen group or a lower alkyl group having from 1 to 6 carbon atoms, $R_2$ is independently selected from the group consisting of carbocyclic, alkyl, aryl and aralkyl, and wherein $R_2$ together can form the atoms necessary to complete a heterocyclic ring with Q, such as pyridinium, Q represents a nitrogen or phosphorous, L represents a divalent group having from 1 to 12 carbon atoms, and X' represents an anionic ion.

Examples of the ethylenically unsaturated monomer of the unit A include olefins (for example, ethylene, propylene, 1-butene, vinyl chloride, vinylidene chloride, isobutene, vinyl bromide, etc.), dienes (for example, butadiene, isoprene, chloroprene, etc.), ethylenically unsaturated esters of fatty acids or aromatic carboxylic acids (for example, vinyl acetate, allyl acetate, vinyl propionate, vinyl butyrate, vinyl benzoate, etc.), esters of ethylenically unsaturated acids (for example, methyl methacrylate, butyl methacrylate, tert-butyl methacrylate, cyclohexyl methacrylate, benzyl methacrylate, phenyl methacrylate, octyl methacrylate, amyl acrylate, 2-ethylhexyl acrylate, benzyl acrylate, maleic acid dibutyl ester, fumaric acid diethyl ester, ethyl crotonate, methylene malonic acid dibutyl ester, etc.), styrenes (for example, styrene, alpha-methylstyrene, vinyltoluene, chloromethyl styrene, chlorostyrene, dichlorostyrene, bromostyrene, etc.), and unsaturated nitriles (for example, acrylonitrile, methacrylonitrile, allylcyanide, crotononitrile, etc.). Among these compounds, the use of the styrenes and/or the methacrylic acid esters is especially desirable in view of (i) their emulsion polymerization properties and (ii) their hydrophobic nature. The A units in the polymer can also include two or more types of the above-mentioned monomers.

Polymers having ionene groups in the chain backbone include, for examples, polymers with the following structures:

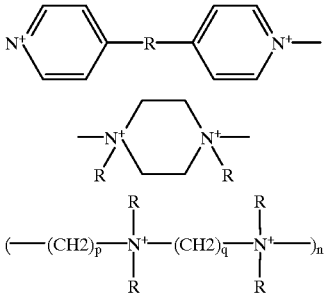

where R is independently selected from the groups consisting carbocyclic, alkyl, aryl, and aralkyl and wherein R together can form the atoms necessary to complete a ring.

More preferably the antistatic agents comprise a crosslinked polymer particle having side groups containing a quaternary ammonium salt group. Polymers having such structures have been described, for example, in U.S. Pat. No. 4,070,189 and 4,735,976.

The composite wax particles of the present invention preferably have a wax phase consisting of greater than 80% by weight of a wax having a melting point of greater than 30° C. and a non-crosslinked polymer phase containing from 1 to 40 percent by weight of a polymerizable mono-alpha, beta-ethylenically unsaturated compound free of ionic charge groups and capable of addition polymerization to form a water soluble homopolymer. The composite wax particle consists of from 15% to 85% by weight of said wax phase and has a mean size smaller than 1 micron. Wax useful for the practice of the invention has been described, for example, in references such as "The Chemistry and Technology of Waxes", A. H. Warth, 2$^{nd}$ Ed., Reinhold Publishing Corporation, New York, N.Y. 1956, and "Plastics Additives and Modifiers Handbook", Chapter 54–59, J. Ederibaum (Ed.), Van Nostrand Reinhold, New York, N.Y. 1992. Suitable waxes include hydrocarbon and/or ester containing waxes, e.g. animal waxes such as beewax, plant waxes such as carnauba wax, paraffin waxes, microcrystalline waxes, Fischer-Torpsch waxes, polyethylene waxes, polypropylene waxes, and a mixture thereof.

The composite wax particle of the present invention is preferably prepared by polymerizing a vinyl monomer mixture in the presence of pre-formed aqueous wax particles. The vinyl monomer mixture comprises at least two polymerizable mono-alpha, beta-ethylenically unsaturated compounds wherein from 1 to 40 percent of at least one of the said compounds are free of ionic charge groups and capable of addition polymerization to form a water soluble homopolymer and at least one of the said compounds is substantially water insoluble and capable of addition polymerization to form a water insoluble homopolymer.

Pre-formed aqueous wax dispersions (or emulsions) are primarily composed of wax particles, dispersants/ surfactants, and water. The dispersants can be nonionic, anionic, and cationic, and can be polymeric and are used at levels as high as 20% of the wax. Wax particles can be formed by various methods known in the art. For example, they can be prepared by pulverizing and classifying dry waxes or by spray drying of a solution containing waxes followed by redispersing the resultant particles in water using a dispersant; they can be prepared by a suspension technique which consists of dissolving a wax in, for example, a water immiscible solvent, dispersing the solution as fine liquid droplets in an aqueous solution, and removing the solvent by evaporation or other suitable techniques; they can be prepared by mechanically grinding a wax material in water to a desired particle size in the presence a dispersant, heating the wax particles dispersed in water to above their melting point, and cooling the melted particles in water to form a stable wax emulsion.

In the present invention, the pre-formed aqueous wax dispersions are preferably formed by the so-called "atmospheric emulsification" and "pressure emulsification" techniques. The atmospheric process is used to prepare wax dispersions for waxes with melting points below the boiling point of water. The process typically consists of melting wax and surfactant together, and optionally a base is added to the melt. Hot water is then slowly added to the wax melt with vigorous agitation (water to wax). Wax emulsions can also be formed by adding the molten wax/surfactant blend to boiling water with vigorous agitation. Pressure emulsification is generally needed for wax with a melting point greater than 100° C. It is similar to the process described above except at temperatures above the water boiling point. Vessels capable of withstanding high pressures are normally used.

Ethylenically unsaturated monomers which are free of ionic charge groups and capable of addition polymerization to form a water soluble homopolymer may include, for example, (meth)acrylamides such as acrylamide, methacrylamde, N,N-dimethyl acrylamide, N-methylol acrylamide, and isopropyl acrylamide, poly(ethylene glycol) (meth)acrylates, N-vinyl-2-pyrrolidone, hydroxyl ethyl methacrylate, hydroxyl ethyl acrylate, vinyl methyl ether, and the like. Ethylenically unsaturated monomers which are substantially water insoluble and capable of addition polymerization to form a water insoluble homopolymer may include virtually all monomers capable of undergoing addition polymerization in emulsion polymerization to produce polymers free of ionic charge groups and essentially water-insoluble. Typical useful monomers thus include, for example, methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, 2-hydroxypropyl methacrylate acrylonitrile, methacrylonitrile, vinyl acetate, vinyl propionate, vinylidene chloride, vinyl chloride, styrene, t-butyl styrene, vinyl toluene, butadiene, isoprene, and the like. The polymerization reaction involved in the present invention is initiated and maintained with an initiating agent or catalyst, which is very similar to those used in a conventional emulsion polymerization. Most useful catalysts for the practice of the present invention are azo and diazo compounds, for example, azobisisobytyronitrile, azobiscyanovaleric acid. The amount of the initiators employed follows generally the practice in a conventional emulsion polymerization. In general, the amounts can vary within the range of about 0.2 to 3 or 4 weight percent or possibly higher by weight of the total monomers. It is generally recognized that a high level of initiators tends to result in lowered molecular weights for the ultimate polymers. If the polymerization is carried out in multiple stages, the amount of initiators in the beginning or initiating stage are adjusted to match the proportion of the monomer then present, and further initiators are fed during the delayed feed stage to correspond to the delayed feed of the monomers. In any case, the initiators are supplied as needed to maintain the reaction in smooth and easily controlled conditions. Surfactants that can be used in the present invention include, for example, a sulfate, a sulfonate, a cationic compound, an amphoteric compound, and a polymeric protective colloid. Specific examples are described in "McCUTCHEON'S Volume 1: Emulsifiers & Detergents, 1995, North American Edition". Chain transfer agents may also be used to control the properties of the polymer particles formed.

Generally speaking, the reaction conditions employed in the execution of the present method parallel those utilized in conventional emulsion polymerization as regards such variables as temperature, time, agitation, equipment, etc. The reaction temperature can be maintained at a constant value or can vary from 50 to 80 or 90° C. If the reaction temperature varies, the starting temperature is usually around 50 to 55° C., and as the reaction proceeds exothermically, the temperature rises.

The time of the reaction is difficult to predict since it will depend upon other variables, such as the amount of initiating agent introduced, the reaction temperature, etc. If the amount of monomer is small, the reaction may be finished within about an hour but with larger amounts the reaction will usually continue for 3 to 4 hours. About ½ to 1 hour of post-heating stage after all monomer has been added can be used to insure that the polymerization has gone to completion and no free monomer is present. The sequence of addition of the various ingredients is not critical and can be varied. Usually, aqueous medium is first added to the reactor, then aqueous wax dispersion, and monomer in that order, all being added while the medium is thoroughly agitated, followed by the initiators, but other sequences are possible.

In one of the preferred embodiments of the invention, the involved polymerization process in the presence of pre-formed aqueous wax particles is carried out sequentially (see, for example, Padget, J. C. in Journal of Coating Technology, Vol 66, No. 839, pages 89 to 105, 1994). In this process, the polymerization is conducted in a monomer-starved manner.

The copolymer contained in the composite wax particles of the invention is properly designed to have good "bonding' with the wax phase and good compatibility in a solvent medium. Defining compatibility of the copolymer in the solvent medium can be achieved by using the concept of "polymer solubility map" (see, for example, Ramsbothan, J. in Progress in Organic Coatings, Vol 8, pages 113–141, 1980; and Wicks, Jr. Z. W., Jones, F. N., and Papas, S. P. in Organic Coatings, pages 229–239, 1992, John Wiley & Sons, Inc.). As the organic solvents, any of the solvents customarily used in coating compositions may be satisfactorily used.

If the polymer contained in the composite wax particle of the invention must be soluble in a non-aqueous medium it is necessary that the polymer be firmly bound either physically or chemically to the wax phase. Otherwise the polymer may be dissolved away from the wax phase and the composite wax particle would lose its stability. Chemical bonding can be achieved by grafting of the polymer to the wax phase. One of the mechanisms may involve abstraction of hydrogen from the wax molecule by free radical present in the system, giving active centers onto which the polymer chain may grow.

Although the polymer phase may be composed of non-crosslinked polymers, the polymers may carry in addition to the polymerizable group a chemically functional group wherein the non-crosslinked polymers are rendered crosslinkable by an external crosslinking agent and can be crosslinked after the application to a substrate of a coating composition into which the composite wax particles are incorporated.

The composite wax particles of the invention may be incorporated directly into a coating composition, the main film forming constituent of which is compatible with the composite wax particles. Alternatively, the composite wax particles may be first isolated from the aqueous dispersion, for example, by spray drying, and then be incorporated into a liquid coating composition as a dry powder.

The antistatic layer of the invention preferably further contains a polymer as binder. Various known polymers are available as the binder. The polymers include thermoplastic resins, thermosetting resins, radiation setting resins, reaction setting resins, mixtures thereof and hydrophilic binders. The amount of the binder in the antistatic layer is preferably in the range of 0.01 to 2 $g/m^2$, and more preferably in the range of 0.015 to 0.5 $g/m^2$.

Examples of the thermoplastic resins include cellulose derivatives (e.g., cellulose triacetate, cellulose diacetate, cellulose acetate maleate, cellulose acetate phthalate, hydroxyacetyl cellulose phthalate, a higher alkyl ester of cellulose, nitrocellulose, cellulose acetate propionate, cellulose acetate butyrate), vinyl copolymers (e.g., vinyl chloride-vinyl acetate copolymers, copolymers of vinyl chloride or vinyl acetate with vinyl alcohol, maleic acid or acrylic acid, vinyl chloride-vinylidene chloride copolymers, vinyl chloride-acrylonitrile copolymers, ethylene-vinyl acetate copolymers), acrylic resins, polyvinyl acetal resins, polyvinyl butyral resins, polyester polyurethane resins, polyether polyurethane resins, polycarbonate polyurethane resins, polyester resins, polyether resins, polyamide resins, amino resins, styrene-butadiene resins, butadiene-acrylonitrile resins, silicone resins and fluorine resins.

The radiation setting resins are formed by introducing a radiation setting functional group into the above-mentioned thermoplastic resins. The functional group has an unsaturated carbon to carbon bond. Examples of the functional groups include acryloyl and methacryloyl.

The hydrophilic polymers include water-soluble polymers, cellulose esters and latex polymers. Examples of the water-soluble polymers include gelatin, gelatin derivatives, casein, agar, sodium alginate, polyacrylic copolymers and maleic anhydride copolymers. Examples of the cellulose esters include carboxymethyl cellulose and hydroxymethyl cellulose. Examples of the latex polymers include vinyl chloride copolymers, vinylidene anhydride copolymers, acrylic ester copolymers, vinyl acetate copolymers and butadiene copolymers.

The antistatic layer of the invention may further contain a hardening agent for the hydrophilic polymer. Examples of the hardening agents include aldehydes (e.g., formaldehyde, glutaraldehyde), ketones (e.g., diacetyl, cyclopentadione), active halogen compounds (e.g., bis(2-chloroethylurea), 2-hydroxy-4,6-dichloro-1,3,5-triazine), active olefin compounds (e.g., divinylsulfone, 5-acetyl-1,3-diacryloylhexahydro-1,3,5-triazine), N-hydroxymethylphthalimide, N-methylol compounds, isocyanates, aziridines, acid derivatives, epoxy compounds and halogenated carboxyaldehydes (e.g., mucochloric acid). Inorganic hardening agents such as chromium alum and zirconium sulfate are also available.

The imaging elements of this invention can be of many different types depending on the particular use for which they are intended. Details with respect to the composition and function of a wide variety of different imaging elements are provided in U.S. Pat. No. 5,300,676 and references described therein. Such elements include, for example, photographic, electrophotographic, electrostatographic, photothermographic, migration, electrothermographic, dielectric recording, ink-jet ink receiving elements, and thermal-dye-transfer imaging elements. Layers of imaging elements other than the image-forming layer are commonly referred to auxiliary layers. There are many different types of auxiliary layers such as, for example, subbing layers, backing layers, interlayers, overcoat layers, receiving layers, stripping layers, antistatic layers, transparent magnetic layers, and the like.

In a particularly preferred embodiment, the imaging elements of this invention are photographic elements, such as photographic films, photographic papers or photographic glass plates, in which the image-forming layer is a radiation-sensitive silver halide emulsion layer. The thickness of the support is not critical. Support thickness of 2 to 10 mil (0.06 to 0.30 millimeters) can be used. The supported can be annealed. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer. The emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar—agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The following examples are used to illustrate the present invention. However, it should be understood that the invention is not limited to these illustrative examples.

EXAMPLES

The conductive polymer particles used in the invention examples is poly(N-vinylbenzyl-N,N,N-trimethylammonium chloride-co-ethylene glycol dimethacrylate) (93:7) (referred to in the examples as VAEG (93:7)). The polymer particle was prepared by emulsion polymerization of chloromethyl styrene with ethylene glycol dimethacrylate to form a latex. The resultant vinyl benzyl halide latex was then reacted with a tertiary amine to form a conductive polymeric microgel before transferred to a relatively hydrophilic solvent such as methanol.

The composite wax particles used in the examples were prepared by the following process: A stirred reactor containing 438.3 g of Michemlube 160 (25% solids, from Michelman, Inc.) was heated to 85° C. and purged with $N_2$ for 2 hour. 0.365 g of azobisisobutyronitrile in 10 g of toluene was then added to the reactor. An emulsion containing 109.6 g of deionized water, 32.9 g of 10% by weight Triton X100 surfactant, 9.1 g of a 10% by weight sodium dodecyl sulfonate surfactant, 87.7 g of methyl methacrylate, 21.9 g of vinyl pyrrolidone, and 0.18 g of azobisisobutyronitrile was added continuously for 2 hours. The reaction was allowed to continue for 4 more hours before the reactor was cooled down to room temperature. The composite wax particle dispersion prepared was filtered through glass fiber to remove any coagulum.

The resultant composite wax particle dispersion has a solid of about 31%. The particle contains about more than 40% by weight of carnauba wax, about 50% by weight of poly(methyl methacrylate-co-vinyl pyrrolidone) (MMA/VP 80/20) with the balance being the amount of stabilizers/dispersants used. The composite wax particle is designated as Wax-1.

Composite wax particles Wax-2 to Wax-7 were prepared in a similar manner. Their compositions and other parameters are listed in Table 1. Composite wax particle Wax-7 has a polymer phase containing an ionizable carboxylic acid group. Composite wax particles Wax-1 to Wax-6 have a polymer phase containing a monomer free of ionic charge group and capable of addition polymerization to form a water-soluble homopolymer.

Other wax particles used in the comparative examples include Teflon 120 from DuPont de Nemours and Co., a polyethylene wax ME 02925 from Michelman Inc., and carnauba waxes SL-506 and SL-508 from Elementis Specialties.

TABLE 1

| Example | Wax Particle | Copolymer Composition |
|---|---|---|
| Wax-1 (Invention) | ML160 (130 nm) From Michelman, Inc. | Poly(methyl methacrylate-co-vinyl pyrrolidone) 80/20 |
| Wax-2 (Invention) | ML160 (130 nm) From Michelman, Inc | Poly(methyl methacrylate-co-vinyl pyrrolidone) 60/40 |
| Wax-3 (Invention) | ML160 (130 nm) From Michelman, Inc | Poly(methyl methacrylate-co-vinyl pyrrolidone) 90/10 |
| Wax-4 (Invention) | ML160 (130 nm) From Michelman, Inc | Poly(methyl methacrylate-co-vinyl pyrrolidone) 95/5 |
| Wax-5 (Invention) | ML160 (130 nm) From Michelman, Inc | Poly(methyl methacrylate-co-hydroxyethylmethacrylate) 87.5/12.5 |
| Wax-6 (Invention) | ML160 (130 nm) From Michelman, Inc | Poly(methyl methacrylate-co-N, N-dimethyl acrylamide) 90/10 |
| Wax-7 (Comparative) | ML160 (130 nm) From Michelman, Inc | Poly(methyl methacrylate-methacrylic acid) 85/15 |

Examples 1–11

Coating Solution Stability

Coating solutions of the antistatic polymer VAEG(93:7), a cellulose diacetate (CDA) binder, and a wax as described above were prepared in an acetone/methanol solvent mixture in the proportions given in Table 2. The coating solution stability was evaluated by visual inspection after storage for 24 hours at room temperature. The results are listed in Table 2. "Settles Out" means that a significant amount of precipitation was seen. "Stable" means that the coating solutions were stable and no precipitation was seen. Superior coating solution stability was obtained for the coating compositions of the invention. Comparative coating solution Example 7 was made with composite wax particle Wax-7 which has a polymer phase containing an ionizable carboxylic acid group, and the resultant coating solution is unstable.

TABLE 2

| Coating Solution Examples | CDA Conc.(wt %) | VAEG (93:7) Conc. (wt %) | Wax/Conc. (wt %) | Solution Stability |
|---|---|---|---|---|
| Example 1 (Invention) | 1.0 | 0.45 | Wax-1/0.3 | Stable |
| Example 2 (Invention) | 1.0 | 0.45 | Wax-2/0.3 | Stable |
| Example 3 (Invention) | 1.0 | 0.45 | Wax-3/0.3 | Stable |
| Example 4 (Invention) | 1.0 | 0.45 | Wax-4/0.3 | Stable |
| Example 5 (Invention) | 1.0 | 0.45 | Wax-5/0.3 | Stable |
| Example 6 (Invention) | 1.0 | 0.45 | Wax-6/0.3 | Stable |
| Example 7 (Comparative) | 1.0 | 0.45 | Wax-7/0.3 | Settles Out |
| Example 8 (Comparative) | 1.0 | 0.45 | Teflon 120/ 0.15 | Settles Out |
| Example 9 (Comparative) | 1.0 | 0.45 | ME 02925/ 0.45 | Settles Out |
| Example 10 (Comparative) | 1.0 | 0.45 | SL-506/0.05 | Settles Out |
| Example 11 (Comparative) | 1.0 | 0.45 | SL-508/0.05 | Settles Out |

Example 12 to 15

Coating Examples

Coating formulations, as seen in Table 3, in acetone/methanol solvent mixtures comprising either 1.45 or 1.75 wt % total solids were applied onto cellulose acetate support. The coatings were dried at 100° C. for one minute to give transparent films with a dry coating weight of 0.2 to 0.3 g/m$^2$.

The surface electrical resistivity (SER) of the example coatings was measured at 50% RH and 72° F. with a Kiethly Model 616 digital electrometer using a two point DC probe method similar to that described in U.S. Pat. No. 2,801,191. The results are given in Table 3 as the logarithm of the measured resistivity values.

The coefficient of friction (COF) was determined using the methods set forth in ANSI IT 9.4-1992. The results are given in Table 3.

TABLE 3

| Coating | Composition (ratio) | SER log Ω/□ | COF |
|---|---|---|---|
| Example 12 (Comparative) | CDA/VAEG (93:7) 70/30 | 9.4 | 0.55 |
| Example 13 (Invention) | CDA/VAEG (93:7)/Wax-3 57/25/18 | 8.7 | 0.25 |
| Example 14 (Invention) | CDA/VAEG (93:7)/Wax-6 57/25/18 | 8.6 | 0.15 |
| Example 15 (Invention) | CDA/VAEG (93:7)/Wax-5 57/25/18 | 8.5 | 0.15 |

The above examples show that the coating compositions of the invention provide transparent films with excellent antistatic properties and excellent frictional characteristics.

While it has been shown and described what are at present the preferred embodiments of the invention, various modifications and alterations will be obvious to those skilled in the art. All such modifications and alterations are intended to be included in the following claims.

What is claimed is:

1. An imaging element comprising:

a support;

at least one imaging layer superposed on said support;

an antistatic layer superposed on said support comprising, a wax particle comprising a wax phase and a polymer phase, the polymer phase formed from an ethylenically unsaturated monomer free of ionic charge groups capable of forming a water soluble homopolymer and a second ethylenically unsaturated monomer capable of forming a water insoluble homopolymer, and an antistatic agent having an ionic group.

2. The imaging element of claim 1 wherein the antistatic agent having an ionic group comprises inorganic salts, ionic conductive polymers, or colloidal metal oxide sols stabilized by salts.

3. The imaging element of claim 1 wherein the antistatic agent having an ionic group comprises an ionene polymer or copolymer.

4. The imaging element of claim 1 wherein the wax phase comprises from 15% to 85% by weight of said wax particle.

5. The imaging element of claim 1 wherein the wax phase comprises animal waxes, plant waxes, paraffin waxes, microcrystalline waxes, Fischer-Torpsch waxes, polyethylene waxes or polypropylene waxes.

6. The imaging element of claim 1 wherein the first ethylenically unsaturated monomer which is free of ionic charge groups comprises (meth)acrylamides, poly(ethylene glycol)(meth)acrylates, N-vinyl-2-pyrrolidone, hydroxyl ethyl methacrylate, hydroxyl ethyl acrylate or vinyl methyl ether.

7. The imaging element of claim 1 wherein the second ethylenically unsaturated monomer capable of forming a water insoluble homopolymer comprises methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, 2-hydroxypropyl methacrylate, acrylonitrile, methacrylonitrile, vinyl acetate, vinyl propionate, vinylidene chloride, vinyl chloride, styrene, t-butyl styrene, vinyl toluene, butadiene or isoprene.

8. The imaging element of claim 1 wherein the antistatic layer further comprises a binder selected from the group consisting of thermoplastic resins, thermosetting resins, radiation setting resins, reaction setting resins, and hydrophilic binders.

9. The imaging element of claim 8 wherein the binder comprises a dry coverage of 0.01 to 2 g/m$^2$.

10. A photographic element comprising:

a support having a first side and a second side;

at least one imaging layer superposed on the first side of said support;

an antistatic layer superposed on the second side of said support comprising, a wax particle comprising a wax phase and a polymer phase, the polymer phase formed from an ethylenically unsaturated monomer free of ionic charge groups capable of forming a water soluble homopolymer and a second ethylenically unsaturated monomer capable of forming a water insoluble homopolymer, and an antistatic agent having an ionic group.

* * * * *